US012789061B2

(12) United States Patent
Zhang

(10) Patent No.: US 12,789,061 B2
(45) Date of Patent: Nov. 10, 2026

(54) PORTABLE BASKETBALL GOAL SYSTEM WITH IMPROVED HEIGHT ADJUSTMENT MECHANISM

(71) Applicant: Suzhou Innovative Sports Goods Co., Ltd., Jiangsu Province (CN)

(72) Inventor: Rongliang Zhang, Kwun Tong (HK)

(73) Assignee: Suzhou Innovative Sports Goods Co., Ltd., Jiangsu (CN)

( * ) Notice: Subject to any disclaimer, the term of this patent is extended or adjusted under 35 U.S.C. 154(b) by 529 days.

(21) Appl. No.: 18/466,703

(22) Filed: Sep. 13, 2023

(65) Prior Publication Data

US 2025/0083013 A1 Mar. 13, 2025

(51) Int. Cl.
*A63B 63/08* (2006.01)
*A63B 63/00* (2006.01)

(52) U.S. Cl.
CPC ..... *A63B 63/083* (2013.01); *A63B 2063/002* (2013.01); *A63B 2225/093* (2013.01)

(58) Field of Classification Search
CPC ..... A63B 63/083; A63B 2063/002; A63B 2225/093; A63B 2210/50
See application file for complete search history.

(56) References Cited

U.S. PATENT DOCUMENTS

| | | | | |
|---|---|---|---|---|
| 6,155,938 | A * | 12/2000 | Mower | A63B 63/083 473/483 |
| 6,419,597 | B1 * | 7/2002 | van Nimwegen | A63B 63/083 473/483 |
| 7,331,883 | B2 * | 2/2008 | Goldberg | A63B 63/083 473/483 |
| 8,992,350 | B2 * | 3/2015 | Green | A63B 63/083 473/484 |
| 10,864,420 | B2 * | 12/2020 | Elpers | A63B 71/023 |
| 2002/0004431 | A1 * | 1/2002 | Nye | A63B 63/083 473/483 |
| 2002/0094890 | A1 | 7/2002 | White et al. | |

* cited by examiner

*Primary Examiner* — Jeffrey S Vanderveen
(74) *Attorney, Agent, or Firm* — LaMorte & Associates P.C.

(57) ABSTRACT

A portable basketball goal assembly and the height adjustment mechanism used within that assembly. The portable basketball goal assembly has a base and a pole that extends vertically from the base. The pole supports at least one support arm that is pivotably connected to the pole. A backboard and hoop are connected to the first end of each support arm. The backboard and hoop are adjusted in height using an adjustment mechanism. The adjustment mechanism has a telescoping body that is connected between the second end of each support arm and the pole. The telescoping body is capable of being selectively adjusted within a range of lengths. By adjusting the length of the telescoping body, each support arm is caused to pivot about its connection to the pole to different degrees. This causes the backboard and hoop to selectively raise and lower.

9 Claims, 5 Drawing Sheets

PORTABLE BASKETBALL GOAL SYSTEM WITH IMPROVED HEIGHT ADJUSTMENT MECHANISM

BACKGROUND OF THE INVENTION

1. Field of the Invention

In general, the present invention relates to portable basketball goal assemblies that have backboards and hoops that can be adjusted in height. More particularly, the present invention relates to the mechanisms that control the height adjustment of the backboard and hoop.

2. Prior Art Description

Many people own portable basketball goal assemblies. These types of assemblies typically have a pole that is mounted to a portable base. The pole holds a basketball hoop and a backboard above a portable base. The base is typically filled with water, sand, or gel to stabilize the basketball goal assembly and ensure that the assembly does not fall over during play.

The regulation height for a basketball hoop is ten feet. However, young players often have difficulty shooting a basketball to that height. As such, many portable basketball goal assemblies have height adjustments that enable the hoop to be selectively lowered. Basketball goal assemblies that are adjustable in height typically attach the basketball backboard to the pole using support arms that can pivot. The backboard is attached to one side of the support arms. The opposite ends of the support arms extend beyond a pivot connection with the pole. Consequently, when the free ends of the support arms are moved up, the basketball backboard and hoop move down and vice versa. The problem has become how to raise and lower the free ends of the support arms in a manner that is safe, stable, and easy to operate by an adult or child.

In U.S. Patent Application Publication No. 2002/0094890 to White, an adjustment system is shown that uses a hand crank to raise and lower the backboard and rim. Crank adjustment systems use tightly threaded rods that are highly susceptible to weather and environmental contamination. As a result, after a year or more of being left exposed to the elements, the ability to adjust the height of the basketball goal system is lost or degrades beyond the strength capabilities of a child.

In U.S. Pat. No. 8,992,350 to Green, an adjustment system is shown that uses a lever system to raise and lower the backboard and rim. The lever is directly connected to the support arms by linkages. Although lever systems are robust and are not easily affected by weather, lever systems do present significant pinch hazards to young children. That is, the movement of the lever and linkages can easily catch a child's hand, hair, clothes, or skin. Furthermore, lever adjustments are complex structures that are expensive to manufacture.

A need therefore exists for a height adjustment system for a portable basketball goal assembly that is highly weather resistant, presents no pinching hazards, and can be manufactured at an economical price. These needs are met by the present invention as described and claimed below.

SUMMARY OF THE INVENTION

The present invention is a portable basketball goal assembly and the height adjustment mechanism used within that assembly. The portable basketball goal assembly has a base and a pole that extends vertically from the base. The pole supports at least one support arm having a first end and a second end, wherein each support arm is pivotably connected to the pole. A backboard and hoop are connected to the first end of each support arm.

The backboard and hoop are adjusted in height using an adjustment mechanism. The adjustment mechanism has a telescoping body that is connected between the second end of each support arm and the pole. The telescoping body is capable of being selectively adjusted within a range of lengths between a long first length and a shorter second length. By adjusting the length of the telescoping body, each support arm is caused to pivot about its connection to the pole to different degrees. This causes the backboard and hoop to selectively raise and lower. Once the backboard and hoop are at a selected height, a locking handle on the telescoping body is used to lock the telescoping body into the fixed length that maintains the selected height.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention basketball goal assembly can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered a limitation when interpreting the scope of the appended claims.

Figure 1:
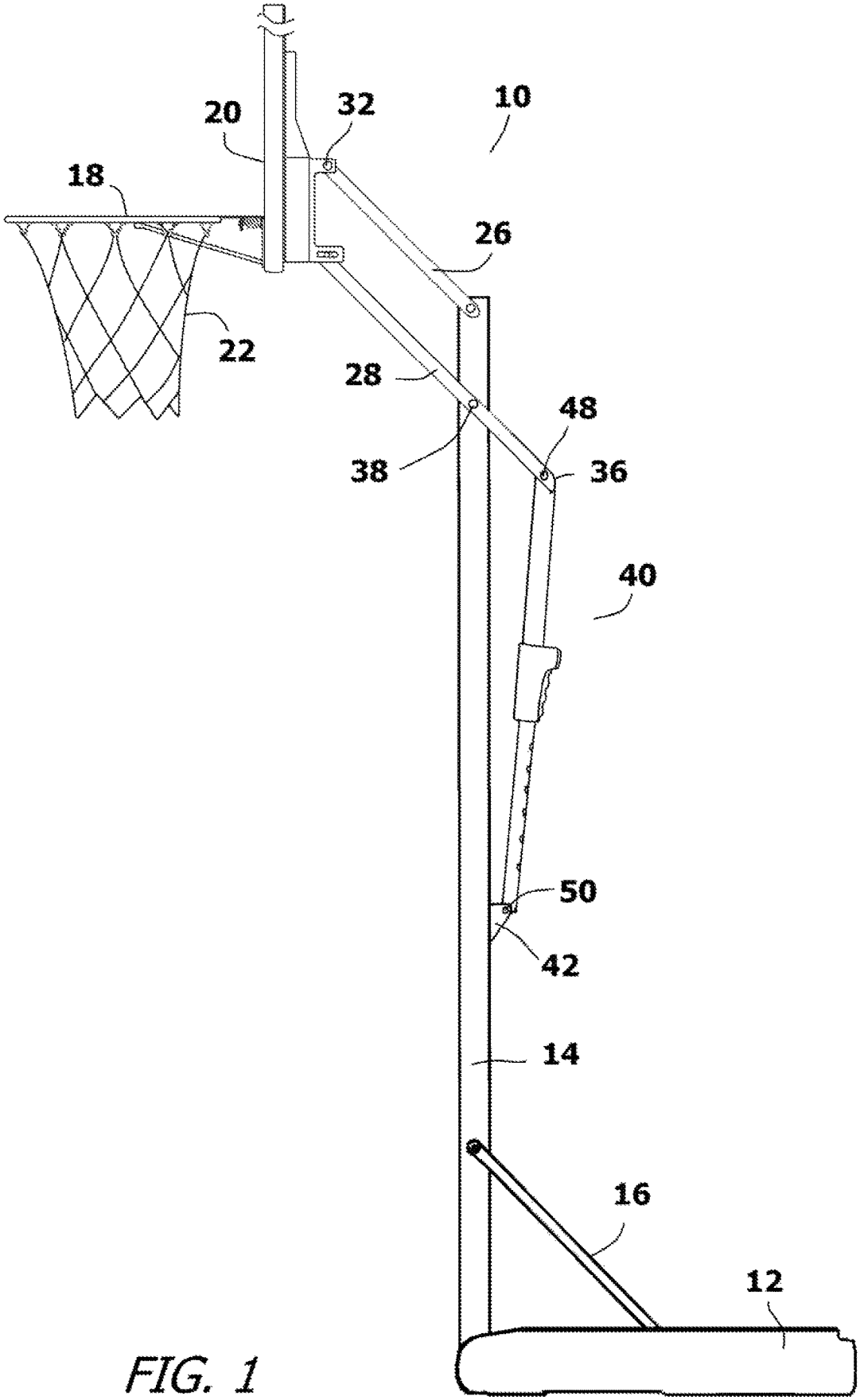
FIG. 1 is an exemplary embodiment of a portable basketball goal assembly.
Figure 2:
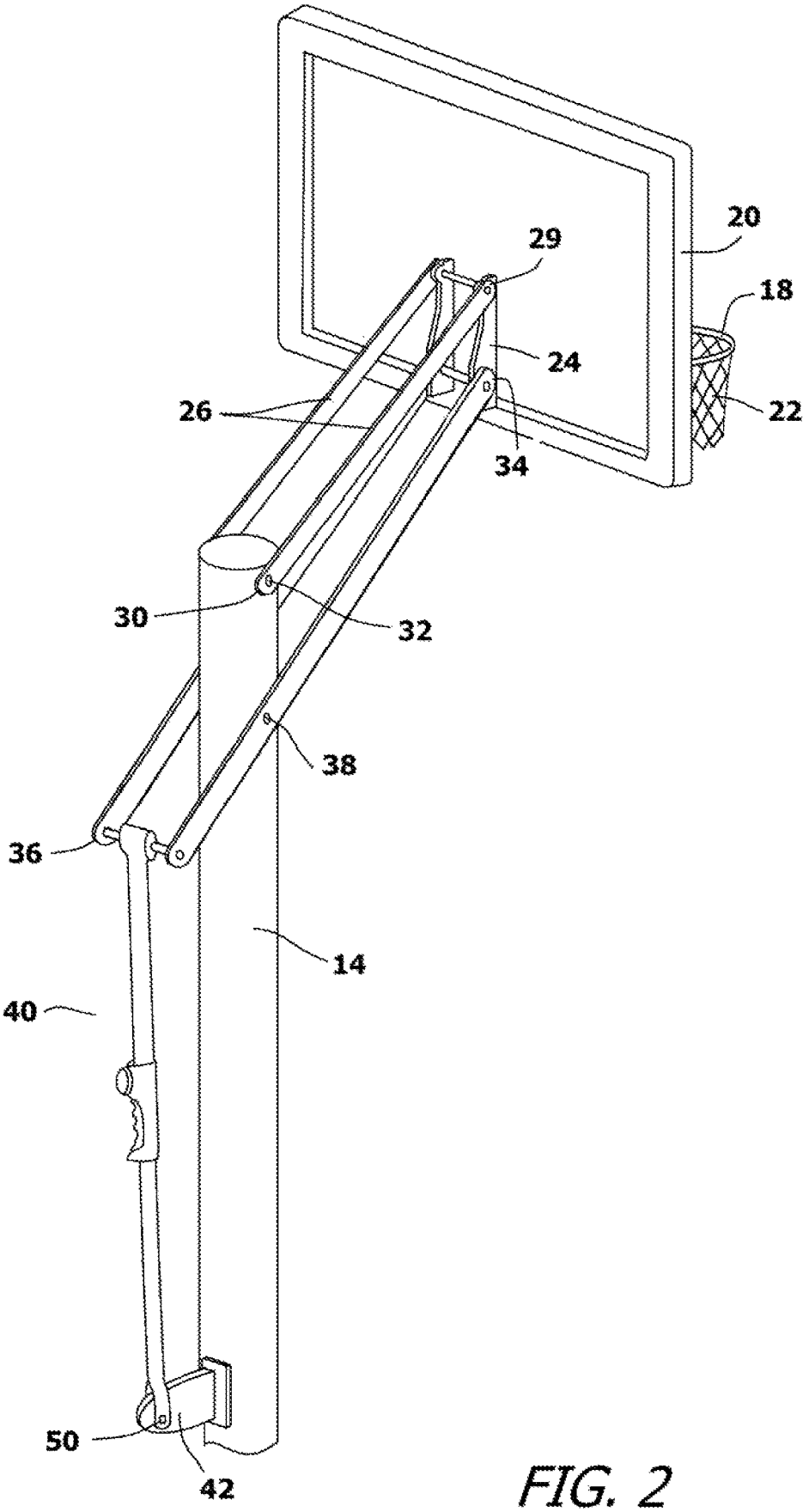
FIG. 2 is a rear view of the exemplary basketball goal assembly highlighting the height adjustment mechanism.

Referring to FIG. 1 and FIG. 2, a portable basketball goal assembly 10 is shown. The portable basketball goal assembly 10 has a base 12. The base 12 can be blow-molded and is capable of holding a significant weight of water, sand, or gel. A pole 14 extends vertically from the base 12. The pole 14 is stabilized by angled brackets 16 that extend from the base 12 to an elevated position on the pole 14. The pole 14 indirectly supports a backboard 20. The backboard 20 supports a hoop 18 and a net 22.

The backboard 20 is mounted to a support bracket 24. The support bracket 24 is attached to various support arms 26, 28 that connect the backboard 20 to the pole 14. A first set of upper support arms 26 have first ends 29 that are pivotably connected to the support bracket 24. The opposite second ends 30 of the upper support arms 26 are attached to an upper axle mount 32 that extends through the pole 14. In this manner, the upper support arms 26 can rotate about the upper axle mount 32 relative to the pole 14.

A set of lower support arms 28 is provided. The lower support arms 28 have first ends 34 that are pivotably connected to the support bracket 24. The opposite second ends 36 of the lower support arms 28 extend beyond the pole 14. At points between the first ends 34 and the second ends 36, the lower support arms 28 are attached to a lower axle mount 38 that extends through the pole 14. In this manner, the lower support arms 28 can teeter about the lower axle mount 38 so that the first ends 34 of the lower support arms 28 move up when the second ends 36 move down and vice versa.

The second ends 36 of the lower support arms 28 attach to an adjustment mechanism 40. The adjustment mechanism 40 attaches the second ends 36 of the lower support arms 28 to an anchor mount 42 on the pole 14. The adjustment mechanism 40 is selectively adjustable in length. When the adjustment mechanism 40 is shortened, the adjustment mechanism 40 causes the second ends 36 of the lower support arms 28 to move toward the base 12. This raises the support bracket 24, backboard 20, and hoop 18 at the opposite end of the lower support arms 28. Conversely, when the adjustment mechanism 40 is lengthened, the adjustment mechanism 40 causes the second ends 36 of the lower support arms 28 to move away from the base 12. This lowers the support bracket 24, backboard 20, and hoop 18 at the opposite end of the lower support arms 28.

Figure 3:
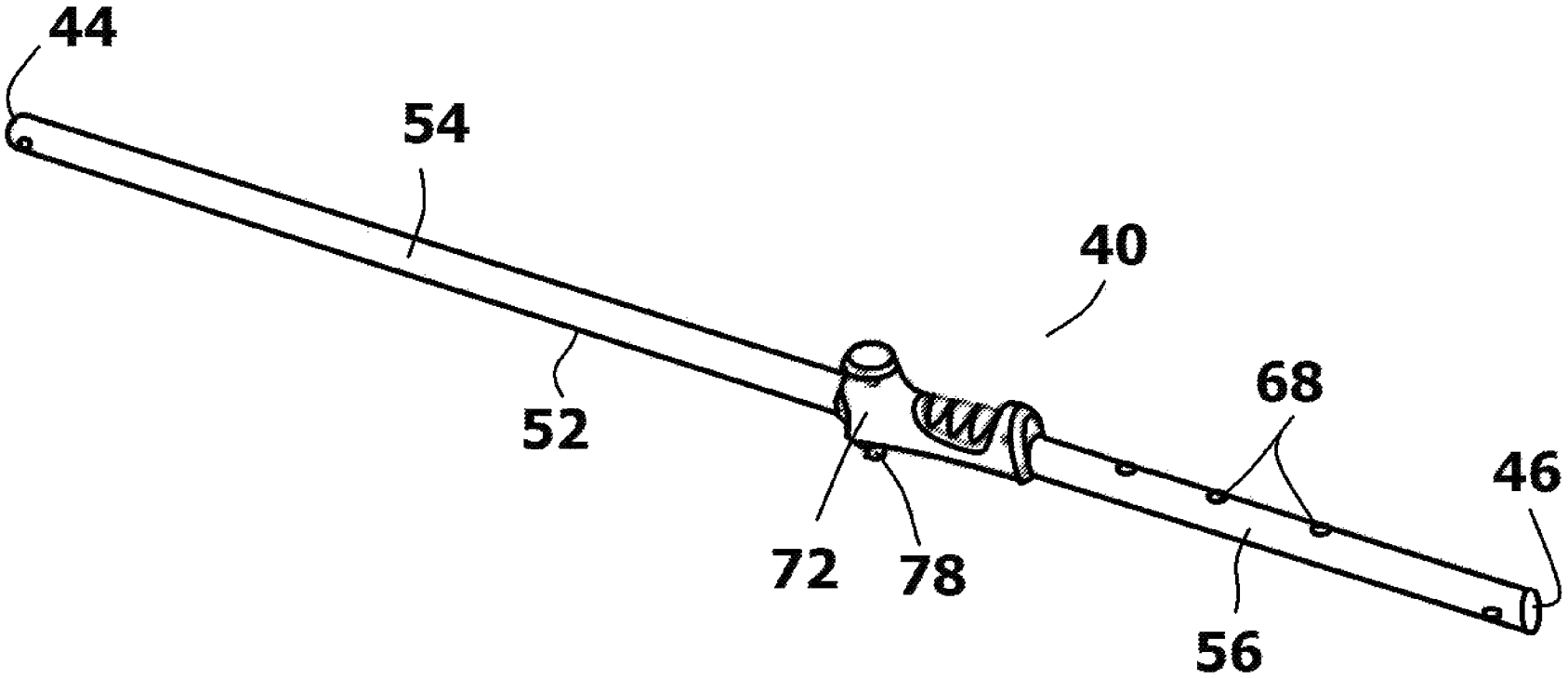
FIG. 3 is a perspective view of the height adjustment mechanism.
Figure 4:
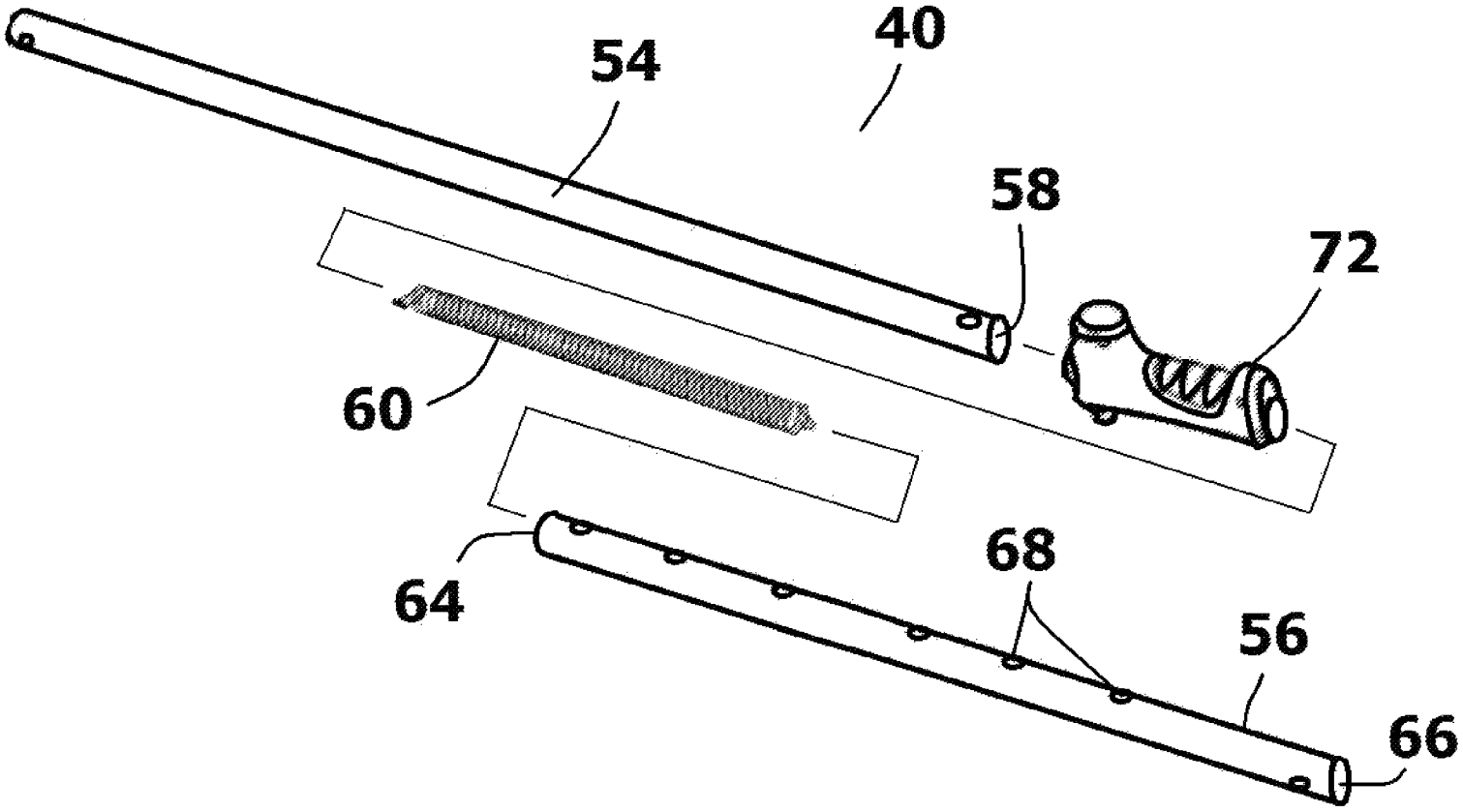
FIG. 4 is an exploded view of the height adjustment mechanism of FIG. 3.
Figure 5:
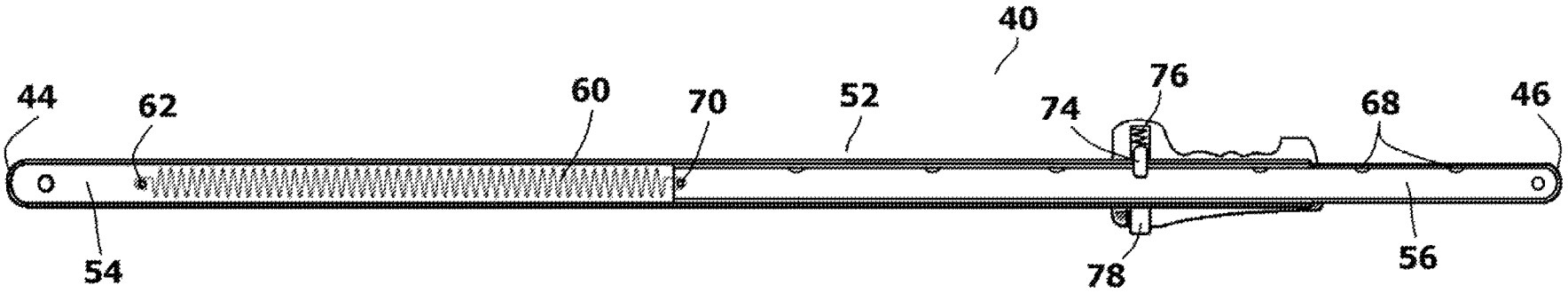
FIG. 5 is a cross-sectional view of the height adjustment mechanism.

Referring to FIG. 3, FIG. 4, and FIG. 5, in conjunction with FIG. 2, it can be seen that the adjustment mechanism 40 has a first end 44 and an opposite second end 46. The first end 44 connects to the lower support arms 28 at a first pivot connection 48. The opposite second end 46 connects to the anchor mount 42 of the pole 14 with a second pivot connection 50. The adjustment mechanism 40 has a telescoping body 52 made from a large diameter first tube 54 that receives a smaller diameter second tube 56. Together, the telescoping body 52 can be adjusted in length through a range of lengths. The large diameter first tube 54 has an open end 58 that receives the smaller diameter second tube 56. A tension spring 60 is provided inside the first tube 54. The tension spring 60 has one end connected to a spring anchor post 62 inside the large diameter first tube 54.

The smaller diameter second tube 56 has a first end 64 and an opposite second end 66. The second end 66 of the smaller diameter second tube 56 attaches to the anchor mount 42 and serves as the second end 46 of the overall adjustment mechanism 40. A series of adjustment holes 68 are periodically spaced along the second tube 56. Inside the second tube 56 is a second spring mounting post 70. The second spring mounting post 70 is disposed near the first end 64 of the second tube 56.

The second spring mounting post 70 engages and retains one end of the tension spring 60. As such, the tension spring 60 has one end that connects to the first spring anchor post 62 inside the first tube 54 and an opposite end that connects to second spring anchor post 62 inside the second tube 56. The tension spring 60 biases the first end 64 of the smaller diameter second tube 56 into the open end 58 of the first tube 56. As such, the tension spring 60 biases the telescoping body 52 toward its shortest length.

In order to extend the second tube 56 out of the first tube 54, the second tube 56 must experience an opposing force that is greater than that supplied by the tension spring 60. A locking handle 72 is provided. The locking handle 72 is affixed to the exterior of the large diameter first tube 54 near the open end 58. The locking handle 72 has an internal lock peg 74 that extends into the large diameter first tube 54. The lock peg 74 is biased into the large diameter first tube 54 by a small spring 76. The lock peg 74 is sized to engage the adjustment holes 68 in the smaller diameter second tube 56. When the lock peg 74 engages an adjustment hole 68, the position of the second tube 56 becomes fixed relative to the first tube 54. The lock peg 74 is linked to a release button 78. When the release button 78 is depressed, the movement raises the lock peg 74 out of contact with smaller diameter second tube 56, therein enabling the smaller diameter second tube 56 to move reciprocally within the larger diameter first tube 54.

In operation, the release button 78 can be depressed. This disengages the lock peg 74 and enables the smaller diameter second tube 56 to reciprocally move relative to the larger diameter first tube 54. A user controls the movement by grasping the locking handle 72 and moving the larger diameter first tube 54 relative to the smaller diameter second tube 56. This selectively elongates or shortens the telescoping body 52. As the length of the telescoping body 52 is selectively adjusted, the distance between the pole anchor mount 42 and the second ends 36 of the lower support arms 28 changes. This rotates the lower support arms 28, therein causing the backboard 20 and hoop 18 to either rise or fall. Once the backboard 20 and hoop 18 are at a selected height, the locking handle 72 is released and the lock peg 74 engages the closest adjustment hole 68, therein setting the length of the telescoping body 52.

The degree of height adjustment can be controlled by the number and spacing of adjustment holes 68 located along the smaller diameter second tube 56. Furthermore, the tolerances between the large diameter first tube 54 and the smaller diameter second tube 56 can be loose. As a consequence, any buildup of rust or contamination will not affect the ability of the telescoping body 52 to adjust in length. The result is an adjustment mechanism 40 that is easy to operate, weather resistant, safe to use, and inexpensive to manufacture.

It will be understood that the embodiment of the present invention that is illustrated and described is merely exemplary and that a person skilled in the art can make many variations to that embodiment. For instance, the positions of the large diameter first tube 54 and the smaller diameter second tube 56 in the adjustment mechanism can be reversed. All such embodiments are intended to be included within the scope of the present invention as defined by the claims.

What is claimed is:

1. A portable basketball goal assembly, comprising;

a base;

a pole that extends vertically from said base;

at least one support arm having a first end and a second end, wherein said at least one support arm is pivotably connected to said pole at a point between said first end and said second end;

a backboard connected to said first end of said at least one support arm;

a first tube having an open end;

a second tube having a first end that passes into said open second end of said first tube, therein forming a telescoping body;

a mounting post disposed inside said second tube proximate said first end of said first tube;

a tension spring mounted at one end inside said first tube wherein said spring extends inside said first tube and engages said mounting post inside said second tube, therein biasing said second tube into said first tube;

wherein said telescoping body is connected between said second end of said at least one support arm and said pole, wherein said telescoping body is capable of being selectively adjusted within a range of lengths between a long first length and a shorter second length; and a locking handle mounted to said first tube that locks said telescoping body to a selected length in said range of lengths.

2. The assembly according to claim 1, wherein said tension spring biases said telescoping body into said second length.

3. The assembly according to claim 1, wherein said telescoping body has a plurality of holes formed therein, wherein said locking handle contains a lock peg that selectively engages said plurality of holes as said telescoping body moves through said range of lengths.

4. The assembly according to claim 3, further including a manual button for lowering and raising said lock peg to selectively engage and disengage said plurality of holes.

5. A portable basketball goal assembly, comprising;

a pole;

a set of support arms having first ends and second ends, wherein said set of support arms are pivotably connected to said pole;

a bracket that supports a backboard and hoop, wherein said bracket is pivotably connected to said first ends of said set of support arms;

a first tube having an open end;

a second tube having a first end that passes into said open second end of said first tube, therein forming a telescoping body;

a mounting post disposed inside said second tube proximate said first end of said first tube;

a tension spring mounted at one end inside said first tube wherein said spring extends inside said first tube and engages said mounting post inside said second tube, therein biasing said second tube into said first tube;

wherein said telescoping body is connected between said second end of said at least one support arm and said pole, wherein said telescoping body is capable of being selectively adjusted within a range of lengths between a long first length and a shorter second length; and a locking handle mounted to said first tube that locks said telescoping body to a selected length in said range of lengths.

6. The assembly according to claim 5, wherein said tension spring biases said telescoping body into a shortest length in said range of lengths.

7. The assembly according to claim 5, wherein said telescoping body has a plurality of holes formed therein, wherein said locking handles contains a lock peg that selectively engages said plurality of holes as said telescoping body moves through said range of lengths.

8. The assembly according to claim 7, wherein said lock peg is biased toward said plurality of holes.

9. The assembly according to claim 8, further including a manual button for lowering and raising said lock peg to selectively engage and disengage said plurality of holes.

* * * * *